United States Patent [19]

Samuelson et al.

[11] 4,372,811

[45] Feb. 8, 1983

[54] ALKALINE OXYGEN DELIGNIFICATION AND BLEACHING OF CELLULOSE PULP IN THE PRESENCE OF AROMATIC DIAMINES

[75] Inventors: Hans O. Samuelson; Kjell E. Abrahamsson, both of Gothenburg, Sweden

[73] Assignee: Mo och Domsjo Aktiebolag, Ornskoldsvik, Sweden

[21] Appl. No.: 260,436

[22] Filed: May 4, 1981

[30] Foreign Application Priority Data

Mar. 21, 1981 [SE] Sweden ..... 8003407

[51] Int. Cl.[3] ..... D21C 3/02; D21C 3/04

[52] U.S. Cl. ..... 162/38; 162/40; 162/65; 162/72; 162/76; 162/77

[58] Field of Search ..... 162/72, 65, 90, 76, 162/45, 37, 66, 67, 77, 40, 19, 43, 44, 38

[56] References Cited

U.S. PATENT DOCUMENTS

| | | | |
|---|---|---|---|
| 3,759,783 | 9/1973 | Samuelson et al. | 162/65 |
| 4,050,981 | 9/1977 | Samuelson et al. | 162/656 |
| 4,089,737 | 5/1978 | Nagano et al. | 162/165 |
| 4,091,749 | 5/1978 | Procter et al. | 162/72 |
| 4,213,821 | 7/1980 | Vanderhoek et al. | 162/72 |
| 4,248,663 | 2/1981 | Kubes et al. | 162/72 |

FOREIGN PATENT DOCUMENTS

| | | | |
|---|---|---|---|
| 2355741 | 6/1974 | Fed. Rep. of Germany | 162/72 |

OTHER PUBLICATIONS

Kubes, "Sulfur-Free Delignification", TAPPI, vol. 61, No. 8, Aug. 1978, pp. 46-50.

*Primary Examiner*—Steve Alvo

[57] ABSTRACT

A process is provided for the alkaline oxygen delignification and bleaching of chemical cellulose pulp while inhibiting degradation of carbohydrates in the pulp, due to the presence of one or more aromatic diamines, preferably having the diamine groups directly linked to an aromatic ring.

31 Claims, No Drawings

ALKALINE OXYGEN DELIGNIFICATION AND BLEACHING OF CELLULOSE PULP IN THE PRESENCE OF AROMATIC DIAMINES

The preparation from lignocellulosic material of chemical pulp requires among other things that the lignin and other noncellulosic compounds be separated from the cellulose fibers, and this is done with digestion chemicals. In the sulfate process, a mixture of sodium hydroxide and sodium sulfide is used as the digestion agent. A considerable drawback with this process is that gaseous, ill-smelling and poisonous substances are formed, which contribute to air pollution. Digestion with sodium hydroxide (misleadingly also called soda cooking) avoids air pollution, but the pulp quality and the cellulose yield are not acceptable. Alkali/oxygen digestion is also a sulfur-free process, but is unfavorable from the standpoint of energy consumption.

Additives have accordingly been suggested, to improve the quality of the pulp.

East German Pat. No. 98,549 suggests the use of anthraquinone monosulfonate in the digestion of lignocellulosic material in an alkaline medium, to increase the yield of cellulose fibers.

U.S. Pat. No. 3,888,727 to Samuel Kenig, patented June 10, 1975, describes the use of anthraquinone mono- and disulfonate or the free acids or mixtures of acids and salts thereof in the digestion of lignocellulosic material in an alkaline medium followed by an alkaline/oxygen gas digestion stage. The most important effect is also an increased cellulose yield.

Canadian Pat. No. 986,662 to Canadian Industries Ltd. describes the treatment of wood with an alkaline solution of an alkali metal salt of an anthraquinone sulfonic acid before starting the digestion, whereby the cellulose yield and degree of efficiency of the additive is increased.

U.S. Pat. No. 4,012,280 to Holton, patented Mar. 15, 1977 also suggests sulfur-free cyclic keto compounds, for instance, anthraquinone, as additives in the alkaline digestion of lignocellulosic material. Increased cellulose yield and increased delignification rate in a sulfur-free alkaline digestion process are claimed.

The use of diketo hydroanthracenes, for instance, 1,4,4a,9a-tetrahydro-9-10-di-keto-hydroanthracene, together with an aromatic nitro compound in the sodium hydroxide digestion (soda cooking) of lignocellulosic material has been suggested in U.S. Pat. No. 4,036,680 to Holton et al, patented July 19, 1977. The advantages obtained are the same as above described. Digestion under alkaline conditions (NaOH-cooking or sulfate cooking) with addition of the above-mentioned diketo hydroanthracenes alone is described in U.S. Pat. No. 4,036,681 to Holton, patented July 19, 1977.

U.S. Pat. No. 4,134,787, patented Jan. 16, 1979, to Eckert, delignifies lignocellulosic material by digesting the lignocellulosic material with an aqueous, alkaline pulping liquor containing from about 0.1% to about 10%, based on the weight of oven-dried lignocellulosic material, of a cyclic amino compound selected from the group consisting of phenazine, dihydrophenazine, quinoxaline, and their alkyl, alkoxy, hydroxy, carboxy and amino derivatives at a temperature of from about 150° C. to about 200° C. for a period of from about 5 to about 480 minutes; and then removing the aqueous pulping liquor from the lignocellulosic material with water or an aqueous wash liquor inert to the lignocellulosic material to obtain a delignified cellulosic material.

Ser. No. 954,816 filed Oct. 26, 1978, now abandoned suggests phenazine compounds having the structure:

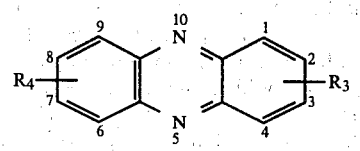

and the quaternary ammonium bases and salts thereof having the general formula:

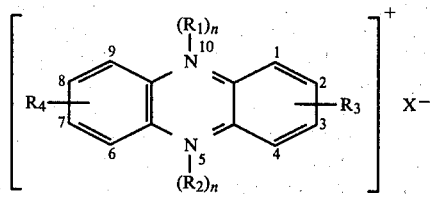

In the above formulae II and III:

(1) $R_1$ and $R_2$, which can be the same or different, are selected from the group consisting of hydrogen, aliphatic and alicyclic hydrocarbon groups and unsubstituted or substituted alkylaryl and aryl groups having from one to about thirteen carbon atoms, and such groups substituted with alkoxy, amino, amido, sulfonic acid, hydroxyl and halide groups;

(2) $R_3$ is selected from the group consisting of hydrogen, halogen, nitro, sulfonic acid, carboxyl, hydroxy, alkoxy, phenoxy, amino, alkyl amino, arylamino, aliphatic and alicyclic hydrocarbon, alkylaryl and aryl groups having from one to about thirteen carbon atoms; a benzene ring condensed with the phenazine ring in the 2,3-position, pyrazine, quinoxaline, 1,4-benzoxazine, benzo (f) quinoxaline and heterocyclic rings condensed with the phenazine in the 1,2- or 2,3-position and selected from the group consisting of five-membered heterocyclic rings with the hetero atoms selected from oxygen, nitrogen and sulfur, and six-membered heterocyclic rings with hetero atoms selected from nitrogen and oxygen; and such groups substituted with alkoxy, amino, amido, sulfonic acid, hydroxyl and halide groups;

(3) $R_4$ is selected from the group consisting of hydrogen, halogen, nitro, sulfonic acid, carboxyl, hydroxy, alkoxy, phenoxy, amino, alkyl amino, aliphatic and alicyclic hydrocarbon, alkylaryl and aryl groups having from one to thirteen carbon atoms, and a benzene ring condensed with the phenazine ring system in the 7,8- or 8,9-position; and such groups substituted with amino, amido, sulfonic acid, hydroxyl and halide groups;

(4) the sum of the number of $R_1$ and $R_2$ substituents does not exceed two and the sum of the number of $R_3$ and $R_4$ substituents does not exceed eight;

(5) $n=0$ or 1; and (6) X is an inorganic or organic anion, of which exemplary anions are OH, halide, such as chloride, iodide or bromide, sulfate, sulfite, nitrate, nitrite, thiocyanate, borate, carbonate, formate, acetate, oxalate, tartrate, citrate, malate, propionate, benzoate, and cyclohexanoate.

Following delignification and digestion, a chemical pulp is often further delignified and bleached before it is capable of use in for instance paper manufacture. Delignification and bleaching can be carried out by various techniques, chlorine usually playing a part. If however pollution is to be held to a minimum, then chlorine has to be avoided in bleaching delignification just as sulfur is avoided in digestion delignification. One way of avoiding chlorine is by alkaline/oxygen bleaching delignification.

Bleaching delignification of cellulose pulp by alkali and oxygen is normally carried out in the following way. After removal of the spent digestion liquor, the pulp is impregnated with sodium hydroxide, and then treated with oxygen gas under pressure at a temperature of about 100° C. for a time period usually amounting to about thirty minutes. In order to inhibit extensive degradation of the carbohydrates in the cellulose pulp, protectors, especially magnesium compounds, are added. It has also been proposed to add magnesium salts in combination with triethanolamine, or to use mixtures or reaction products of ethylenediamine with certain aminomethylene phosphonic acids, as a complex-forming agent.

In spite of such expedients, the delignification can only be carried up to the removal of about 50% of the residual amount of lignin in the digested pulp. If the delignification is carried further, the degradation of the carbohydrates becomes so serious that the strength properties of the bleached pulp are seriously impaired. Normally, then, the oxygen bleaching is started at a lignin content corresponding to a Kappa number of 30 to 40, when dealing with kraft pulp from softwood, which is the usual starting material, and proceeds to a lignin content corresponding to Kappa number 15 to 20. Lignin remaining after this treatment normally has to be removed by treatment with chlorine, alkali, and chlorine dioxide.

It is well known that chlorine bleaching of cellulose pulp gives rise to chlorinated substances which accumulate in the food chain, being taken up by fish, for example, and that these substances do not disappear in biological purification of the waste water. Some chlorinated substances have been shown to be mutagenic. The aqueous effluent from chlorine bleaching plants is thus regarded as one of the most serious discharge problems in countries which produce bleached cellulose pulp.

Some attention has therefore been given to possible additives for use in oxygen bleaching that would either be superior protectors, compared to magnesium compounds, or give an improved effect in combination with magnesium compounds. Unfortunately, it has been found however that many suggested additives which give improved selectivity (defined as viscosity at a given lignin content of the oxygen bleached pulp) lose their effectiveness in the presence of magnesium compounds. An example is triethanolamine, which is an effective complexing agent for iron compounds. Other additives give rise to products which are so dangerous to the environment that they cannot be used. Formaldehyde improves selectivity in combination with magnesium compounds, but hydrogen gas is then liberated in the oxygen reactor, which poses an explosion danger. While several types of complexing agents complement the effect of magnesium compounds, their selection is governed by other conditions. Some complex forming agents which give an improved effect when combined with the magnesium compound with certain unbleached pulps lead to a decreased selectivity with other pulps.

The problem has been to find an additive which makes possible an extensive oxygen delignification by protecting the carbohydrates, at first hand the cellulose molecules, against depolymerization in alkaline oxygen bleaching. The additive should preferably give a considerable protective effect in combination with other protective additives such as magnesium compounds, and must not pose a serious danger to the environment, or give rise to products which adversely affect the environment, or prevent the use of the spent bleaching liquor as fuel.

In accordance with the present invention, it has been determined that aromatic diamines, preferably having two amino groups directly attached to the aromatic ring, act as protectors during the oxygen delignification and bleaching, and complement the effect of magnesium protectors, if also present.

The invention accordingly provides a process for the alkaline oxygen delignification and bleaching of chemical cellulose pulp while inhibiting degradation of carbohydrates in the cellulose pulp, which comprises delignifying and bleaching chemical cellulose pulp in the presence of an aromatic diamine, and, optionally, a magnesium protector, with oxygen and alkali under superatmospheric pressure at an elevated temperature of at least 80° C. The alkali is present in an aqueous alkaline liquid phase, acting as a reaction medium in which the cellulose pulp is dispersed, and oxygen gas is added to the reaction medium, and dispersed therein during the process. The aromatic diamine and any magnesium protector are present in or added to the alkaline liquid phase.

At least one and preferably both of the two amino groups is directly attached to an aromatic ring. Superior results have been obtained with aromatic diamines in which both the amino groups are attached to an aromatic ring, preferably the same aromatic ring, as in the case of the phenylene diamines, which are the preferred group of protective aromatic diamines.

The aromatic ring or rings of the aromatic diamines can also carry other substituents, for instance, hydroxyl groups and/or carboxyl groups, linked either directly to the aromatic ring or indirectly to an aliphatic side chain of up to about six carbon atoms in a straight chain before the amino group. Diamines based on naphthalene or diphenyl and other aromatic hydrocarbons having more than two aromatic rings can also be used.

The aromatic diamines can accordingly be defined by the general formula:

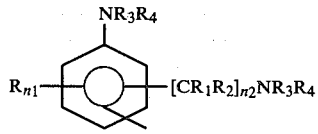

in which:

R is selected from the group consisting of hydrogen, alkyl, aryl and alkylaryl (the aryl including aryl condensed with the

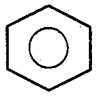

ring), cycloalkyl and alkyl cycloalkyl (the cycloalkyl including cycloalkyl condensed with the

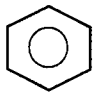

ring), the alkyl having from one to six carbon atoms, the aryl having from six to eighteen carbon atoms, the cycloalkyl having from five to seven carbon atoms; hydroxyl and carboxylic acid;

$R_1$, $R_2$, $R_3$ and $R_4$ are selected from the group consisting of hydrogen, alkyl having from one to six carbon atoms, aryl having from six to ten carbon atoms, and cycloalkyl having from five to eight carbon atoms;

$n_1$ is a number from one to four; and $n_2$ is a number from zero to six.

If there are several

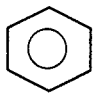

rings, including condensed rings, the amino groups can be in the same or different rings. The amino groups can be in o-, m- or p-positions on the ring.

Exemplary R, $R_1$, $R_2$, $R_3$ and $R_4$ alkyl include methyl, ethyl, propyl, isopropyl, butyl, isobutyl, tert-butyl, sec-butyl, amyl, isoamyl, hexyl and tert-hexyl.

Exemplary R, $R_1$, $R_2$, $R_3$ and $R_4$ aryl include phenyl, diphenyl, naphthyl, phenanthryl, and anthracenyl.

Exemplary R, $R_1$, $R_2$, $R_3$ and $R_4$ alkaryl include phenmethyl (benzyl), phenethyl, phenpropyl, phenisopropyl, phenbutyl, phenamyl and phenhexyl.

Exemplary R, $R_1$, $R_2$, $R_3$ and $R_4$ cycloalkyl include cyclopropyl, cyclohexyl, cycloheptyl and cyclooctyl; and exemplary alkyl cycloalkyl include methyl-, ethyl-, propyl-, butyl-, amyl- and hexyl-substituted such cycloalkyl groups.

Examples of aromatic diamines having the above structure include various isomeric diaminophenyl acetic acids, diaminobenzoic acids, diaminobenzyl alcohols, diaminophenols, and diaminonaphthols. Under the conditions observed, the phenylenediamines, and preferably those having $NH_2$ groups, have special advantages. N-methyl phenylenediamines can give good results, but effectiveness progressively decreases as the substituted groups increase in molecular weight.

Among the isomeric phenylenediamines, orthophenylenediamine is the preferred protector, especially when using the preferred embodiment, in which spent liquor from the oxygen delignification is recycled to the oxygen delignification.

It has not been possible to establish the mechanism by which the aromatic diamines protect the carbohydrates against degradation during the oxygen bleaching and delignification. Magnesium is nowadays thought to deactivate metal compounds which are capable of decomposing peroxides and give rise to aggressive intermediates which attack the carbohydrates. Other effects of magnesium salts have also been proposed, but the evidence relied on for the proposed theories does not seem entirely reliable.

The aromatic diamines seem to have a different mode of action from magnesium additives, because large complementary effects are obtained from combinations of magnesium with surprisingly small amounts of the diamines. Analysis for metal compounds of the spent bleaching liquors and waste liquors from oxygen bleaching and delignification in the presence of the diamines have shown that the effect on the amounts of dissolved metal compounds is not significant. This together with the totally surprising relation between the protective effect and the amount of aromatic diamine added shows that the protective effect does not depend on the formation of soluble complexes with deleterious metallic compounds present in the system.

While the aromatic diamine can be added to the alkaline delignification reaction medium or aqueous alkaline liquid phase either before or during delignification, or both, the amount of aromatic diamine is important to selectivity. Very surprisingly, it has been found that the selectivity is improved when the diamine is added in small amounts, for instance, 0.002 g/l, to the liquid phase during delignification, while addition of amounts as high as 1 g/l decreases selectivity. Suitably, the amount added is within the range from about 0.002 to about 0.8 g/l. For optimum selectivity, the amount added normally is from about 0.01 to about 0.2 g/l. The amount added refers to the amount of diamine that is newly or freshly added.

The upper limit on the amount added applies to the case when no spent bleaching liquor from the oxygen delignification is recycled. In the preferred embodiment the spent bleaching liquor is recycled, and in this case the amount added can be decreased without impairing the selectivity. Thus, the process gives optimum results under conditions which are economically advantageous, and the additions are so small that the discharge of reaction products can be held at a very low level.

Spent bleaching liquor recycling is usually desirable in order to obtain optimum selectivity in the process of the invention, when bleaching either at a low pulp consistency or at a high consistency. The recycling of spent bleaching liquor is advantageously carried out by using spent bleaching liquor for displacement of spent digestion liquor, and/or by adding spent bleaching liquor after the spent digestion liquor has been substantially all washed out.

An important advantage of aromatic diamines, as compared to most previously suggested protectors, is that they display a high protective effect against carbohydrate degradation when one or more magnesium compounds is added to the process. The amount of magnesium compound added is the usual amount, within the range from about for instance, 0.02 to about 0.5%, calculated as magnesium, and based on the dry weight of the pulp. Magnesium present in the recycled spent liquor or waste liquor is not counted.

Alkali is added as a neutralization agent. An alkali metal hydroxide, usually sodium hydroxide, for instance in the form of oxidized white liquor, can be used. Sodium carbonate and/or sodium bicarbonate can also be used, as well as magnesium hydroxide.

One advantage of the process of the invention is that it requires no special equipment, except for containers for storage and devices for dosage. The addition of the aromatic diamine, for example, can be carried out simultaneously with the addition of a protector such as a magnesium compound or in connection with the addition of the alkali or neutralization agent. In low consistency bleaching or in multistage bleaching, the aromatic diamine can be injected during the course of the process.

The process of the invention is particularly advantageous in the alkaline treatment of lignin-containing cellulose pulp in the presence of oxygen gas or air, for the purpose of removing lignin. This process is referred to in the art as alkaline oxygen gas bleaching.

The additives employed in the process of the invention have the important property of reducing or entirely preventing the attack of oxygen on the carbohydrates present in the cellulose and hemicellulose, without to any notably great extent affecting the oxidation of lignin and its dissolution. This protective effect is most noticeable with regard to the attack of oxygen on the cellulose molecule, and primarily the attack of oxygen along the anhydroglucose chain of the cellulose molecule, an attack which gives rise to a rapid lowering of pulp viscosity. Thus, in the presence of the additives of the invention, the treated delignified pump is found to have a higher viscosity than would be obtained in their absence.

The process of the invention is applicable to unbleached, partially bleached or bleached chemical cellulose pulps, prepared from any cellulose source by any chemical pulping process, for example, soda pulp, sulfate pulp, kraft pulp, sulfite pulp, and semichemical pulp, and especially to alkaline-digested pulp. Examples of alkaline digested pulps are kraft pulp, polysulfide pulp and soda pulp. "Soda pulp" includes pulps which are digested with sodium hydroxide as the digestion chemical in the presence of additives such as redox catalysts, for instance, anthraquinone.

The invention is applicable to chemical cellulose pulps derived from all kinds of wood, such as spruce pulp, pine pulp, hemlock pulp, birch pulp, fir pulp, maple pulp, alder pulp, aspen pulp, eucalyptus pulp, cherry pulp, sycamore pulp, hickory pulp, ash pulp, beech pulp, poplar pulp, oak pulp, and chestnut pulp. The invention is particularly advantageous in the preparation of any pulp in which it is especially desired to avoid degradation of the cellulose during processing, such as most grades of paper pulp.

As indicated, magnesium protectors complement the effect of the aromatic diamine, giving an additive or even synergistic protective effect.

As a source of magnesium, any magnesium salts, oxide or hydroxide, can be added, directly to the delignification reaction, or to regenerate a spent treatment liquor, or to prepare a waste liquor or other material for use in the process. Any water-soluble or -insoluble magnesium compound can be used, such as, for example, magnesium sulfate, magnesium chloride, magnesium bromide, magnesium chlorate, magnesium potassium chloride, magnesium formate, magnesium acetate, magnesium oxide, magnesium hydroxide, and magnesium nitrate. If it is desired to recover the liquor after the treatment, then it is usually preferable to employ a magnesium compound that avoids the introduction of foreign anions into the system. Magnesium compounds which have no deleterious anion or which have an anion which is destroyed in the course of the process include magnesium oxide, magnesium hydroxide, magnesium sulfate, and magnesium carbonate.

Any water-insoluble magnesium compounds can be combined with complexing agent in the presence of water, and form a soluble complex, before combining with the pulp, or before commencing the alkaline oxygen gas reaction. Any magnesium compounds sparingly soluble in water can be used in this way, for instance, magnesium oxide or hydroxide, magnesium phosphate, magnesium silicate and magnesium sulfide.

Soluble complex magnesium aminopolycarboxylic acid salts are formed from aminopolycarboxylic acids having the formula:

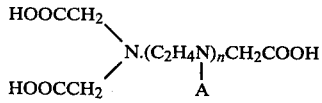

or alkali metal salts thereof, in which A is the group $-CH_2COOH$ or $-CH_2CH_2OH$, where n is an integer from zero to five. The mono, di, tri, tetra, penta and higher alkali metal salts are useful, according to the number of acid groups available and converted to alkali metal salt form.

Examples of such aminopolycarboxylic acids are ethylenediaminetetraacetic acid, nitrilotriacetic acid, diethylenetriaminopentaacetic acid, ethylenediaminetriacetic acid, tetraethylenepentaamineheptaacetic acid, and hydroxyethylethylenediamine triacetic acid, and their alkali metal salts, including the mono, di, tri, tetra and penta sodium, potassium and lithium salts thereof. Other types of aminocarboxylic acids which can be used to advantage are iminodiacetic acid, 2-hydroxyethyliminodiacetic acid, cyclohexanediaminetetraacetic acid, anthranil-N,N-diacetic acid, and 2-picolylamine-N,N-diacetic acid.

The magnesium complexes with these acids by forming salts with the acid groups and by chelation with the nitrogen-containing groups or hydroxy groups, if present.

Another class of water-soluble complex magnesium compounds of magnesium is formed with aliphatic alpha-hydroxycarboxylic acids of the type RCHOHCOOH and the corresponding beta-hydroxycarboxylic acid $RCHOHCH_2COOH$. These chelates are of the type:

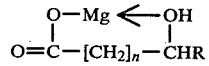

In the above formula, n is zero or one. When n is zero, the acid is an alpha-hydroxy acid, and when n is one, the acid is a beta-hydroxy acid.

R in the above formula is hydrogen or an aliphatic radical, which may be a hydrocarbon radical having from one to about ten carbon atoms, or a hydroxy-substituted hydrocarbon radical having from one to nine hydroxyl groups, and from one to about ten carbon atoms.

Exemplary alpha- and beta-hydroxy carboxylic acids are glycolic acid, lactic acid, glyceric acid, $\alpha,\beta$-dihydroxy-butyric acid, $\alpha$-hydroxy-butyric acid, $\alpha$-hydroxy-isobutyric acid, $\alpha$-hydroxy-n-valeric acid, $\alpha$-hydroxy-isovaleric acid, $\beta$-hydroxy-butyric acid, $\beta$- hydroxy-isobutyric acid, β-hydroxy-n-valeric acid, β-hydroxy-isovaleric acid, erythronic acid, threonic acid, trihydroxy-isobutyric acid, and saccharinic acids and aldonic acids, such as isosaccharinic acid, gluconic acid, galactonic acid, talonic acid, mannonic acid, arabonic acid, ribonic acid, xylonic acid, lyxonic acid, gulonic acid, idonic acid, altronic acid, allonic acid, ethenyl glycolic acid, and β-hydroxyisocrotonic acid.

Also useful are organic acids having two or more carboxylic groups, and no or from one to ten hydroxyl groups, such as oxalic acid, malonic acid, tartaric acid, malic acid, and citric acid, ethyl malonic acid, succinic acid, isosuccinic acid, glutaric acid, adipic acid, suberic acid, azelaic acid, maleic acid, fumaric acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

The polyphosphoric acids are also good complexing agents for magnesium, and the magnesium salts of these acids are useful in combinations with the complex magnesium aminopolycarboxylic acid salts. Exemplary are disodium-magnesium pyrophosphate, trisodium-magnesium tripolyphosphate and magnesium polymetaphosphate.

Also useful are the aminomethylene phosphonic acids, such as diethylenetriaminepentamethylene phosphonic acid. (DTPMP)

Especially advantageous in such combinations from the standpoint of cost are the acids naturally present in waste liquors obtained from the alkaline treatment of cellulosic materials. These acids represent the alkali- or water-soluble degradation products of polysaccharides which are dissolved in such liquors, as well as alkali- or water-soluble degradation products of cellulose and hemicellulose. The chemical nature of these degradation products are complex, and they have not been fully identified. However, it is known that saccharinic and lactic acids are present in such liquors, and that other hydroxy acids are also present. The presence of $C_6$-isosaccharinic and $C_6$-metasaccharinic acids has been demonstrated, as well as $C_4$- and $C_5$-metasaccharinic acids. Glycolic acid and lactic acid are also probable degradation products derived from the hemicelluloses, together with beta-gamma-dihydroxy butyric acid.

Carbohydrate acid-containing cellulose waste liquors which can be used include the liquors obtained from the hot alkali treatment of cellulose, liquors from sulfite digestion processes, and liquors from sulfate digestion processes, i.e., kraft waste liquor. The waste liquors obtained in alkaline oxygen gas bleaching or digestion processes and alkaline peroxide bleaching processes can also be used. In this instance, the alkaline liquor can be taken out from the process subsequent to completing the oxygen gas treatment stage, or during the actual treatment process.

The complex magnesium salts can be formed first, and then added to the cellulose pulp. They can also be formed in situ from a water-soluble or water-insoluble magnesium salt, oxide or hydroxide, in admixture with the complexing acid, the aminopolycarboxylic acid, hydroxycarboxylic acid, or polyphosphoric acid, or salt thereof, and this mixture can be added to the pulp. For instance, a waste liquor employed as a source of complexing acid or anhydride or salt thereof can be mixed with a magnesium salt, oxide or hydroxide, before being introduced to the process, or the magnesium salt, oxide or hydroxide can be added to the pulp, and then the pulp brought into contact with the complexing acid or anhydride or salt thereof. It is also possible to combine the complexing acid or anhydride or salt thereof with the pulp, and then add the magnesium salt, oxide or hydroxide, but this method may be less advantageous in practice.

Upon conclusion of the alkaline oxygen gas treatment, it is possible to separate the magnesium-containing waste liquor and recycle it for reuse. The consumption of magnesium salts is negligible, and usually it is not even necessary to replenish the magnesium content before recycling. However, additional magnesium compound can be added before recycling, if necessary, to restore the magnesium content, as MgO, and maintain a high enough level, for instance, to prevent oxidative degradation of the cellulose or hemicellulose. The consumption of magnesium salt has been noted to be particularly low when waste liquor from a part of the alkaline oxygen gas treatment process is employed as the source of complexing acid, and recycled for continued treatment of new batches of pulp.

Some wood pulps are particularly high in magnesium ion because of the nature of the pulp or of the pulping process. For example, unbleached pulps produced by digestion of wood with magnesium bisulfite or magnesium sulfite usually contain enough magnesium ion so that no addition of magnesium compound need be made. Waste liquors from these processes can be used per se, in the process of the invention, inasmuch as they already contain the complexing acids, and a sufficient proportion of magnesium as well.

It has been surprisingly found that in the presence of any of the above chelating or complexing compounds during the oxygen delignification enhance the effect of the aromatic diamines.

At an amount of, for example, 0.2% of magnesium, based on the dry weight of the pulp, 0.2% DTPMP based on the dry weight of the pulp, and 0.05 g/l of orthophenylene diamine have given a significantly higher selectivity than was obtained under the same conditions except for omission of the DTPMP. If the amount of DTPMP was increased to 2%, on the other hand, an inferior selectivity was obtained, compared to the run without DTPMP.

If the amount of magnesium is decreased, the amount of complex forming agent should also be decreased. Tests have shown that the addition of complex forming compound should be adjusted so that the pulp or the pulp suspension during the oxygen delignification stage contains at least a small amount of magnesium compounds which are insoluble in the bleaching liquor, but soluble in dilute acid, such as magnesium hydroxide. The amount of undissolved magnesium compounds soluble in 0.1 M hydrochloric acid at room temperature should preferably amount to 0.03% by weight, calculated as magnesium, based on the dry weight of the cellulose pulp.

The alkaline bleaching and delignification of the pulp in the presence of oxygen is carried out in the normal way.

In order to obtain a rapid reaction between the cellulosic material and the oxygen gas or air supplied to the system, the partial pressure of oxygen at the beginning of the bleaching should be at least one atmosphere. However, lower pressures can be used, when a slower reaction is acceptable. When using pure oxygen gas, the process can be carried out at pressures approximating atmospheric pressure, while if air is used, because of the lower proportion of oxygen, higher pressures, usually superatmospheric pressures, are employed. If oxygen is used, a practical upper limit is 20 atmospheres, while if air is used, a practical upper limit is 60 atmospheres. The higher the pressure, the more rapid the reaction. Usually, an oxygen gas pressure within the range from about 2 to about 12 atmospheres is preferred.

It is frequently expedient to supply the oxygen gas or air during the process, and to release air enriched with regard to inert gas during the process.

The reaction will proceed at low temperatures, of the order of 25° to 50° C., but then the reaction is slow, and a large reaction vessel is necessary. Consequently, in order to reduce reaction time to a practical range, and keep the equipment small, the bleaching is usually carried out at a temperature within the range from about 80° to about 150° C. If it is desired to reduce the viscosity of the pulp, the higher temperatures can be used, of the order of 130° to 140° C. When treating sulfate paper pulps, a lower temperature is used, if a significant reduction of the hemicellulose content is not desired. If a significant reduction of the hemicellulose is desired, however, then it is desirable to employ a rather high temperature. Usually, in the case of sulfate paper pulps, the treatment is carried out advantageously at from 90° to 100° C.

The temperature can be varied upwardly or downwardly, progressively or continuously, during the process. It is in many cases desirable to begin the reaction at a low temperature, and then to gradually increase the temperature during the reaction. This is particularly true in the case of pulps containing hemicellulose which is an unoxidized condition is attacked by alkali, for example, sulfite pulps, and semichemical pulps. Thus, the reaction temperature is low while the hemicellulose remains unoxidized, but as it becomes oxidized, in the course of the reaction, the temperature can be increased, thus reducing the total reaction time.

The concentration of cellulosic material (pulp consistency) in the reaction mixture can be varied within wide limits, and is in no way critical. Concentrations within the range from about 1 to about 40% are employed. It is, however, preferable to effect the treatment at a concentration in excess of 8% up to about 35%, and preferably within the range from about 27% to about 34%. When high pulp concentrations are treated, the pulp can be shredded mechanically after or at the same time as the reagent chemicals are added to the reaction mixture.

In a preferred embodiment of the invention, which gives a particularly uniform bleaching and a pulp whose properties can be controlled within the narrow limits, the cellulosic material is first impregnated with an aqueous solution of the complexing compound, magnesium protector, and aromatic diamine, before being treated with air or oxygen. The excess of the impregnating solution can then be removed, for example, by filtering and/or by pressing, before the treatment is begun. The solution that is removed can, of course, be used for impregnating additional cellulosic material.

The amount of alkali required in the bleaching depends on the quantity of lignin and/or hemicellulose which it is desired to remove. Normally, the alkali charge (calculated as NaOH) is within the range from about 1 to about 10% NaOH, based on the weight of the cellulosic material present. Other alkalis can be used, such as potassium hydroxide or lithium hydroxide, and sodium carbonate, in which event the amounts are changed proportionately. If it is desired to dissolve large quantities of lignin and/or hemicellulose during the process, an alkaline charge within the range of about 7 to about 10% can be used. When bleaching a pulp having a low lignin content, in which case a smaller amount of lignin and/or hemicellulose is to be dissolved, the charge can be within the range from about 1 to about 7%. It has been found to be especially advantageous to use a low alkali addition, for instance, 1.5% or at most 3% NaOH in the oxygen stage, and to recycle spent oxygen stage liquor to the oxygen stage.

The proportion of hemicellulose dissolved decreases as the amount of alkali is reduced, and accordingly, the amount of both the lignin and the hemicellulose dissolved can be regulated by control of the amount of alkali added.

It may be advantageous to add only a portion of the total quantity of alkali at the beginning of the process, and then add additional alkali as the reaction proceeds. The alkali attacks the lignin preferentially, and by limiting the amount of alkali present at any given time, it is possible to remove the lignin with a minimum of attack upon the cellulose and hemicellulose in the course of the reaction. The desired grade of pulp can thus be controlled by the manner and rate at which the alkali is charged to the system, and the size of the alkali charge, and the reaction time.

The alkali can be combined with the pulp either before, during, or after combination with the additives, and it can be introduced in whole or in part in this way. The mixing with alkali can be effected at the desired reaction temperature, or at a lower temperature, after which the temperature is increased to reaction temperature.

The reaction time required depends upon the oxygen gas pressure and the reaction temperature. It is especially suitable to use a longer treating time for the oxygen treatment than is usual, for instance, from about 60 to about 500 minutes, suitably from 90 to 300 minutes, preferably from 90 to about 180 minutes. The treatment temperature in the oxygen stage is within the range from about 80° to about 150° C., suitably from 100° to 130° C., preferably from 100° to 115° C. The reaction time is easy to control, since the reaction halts when the alkali is consumed, and thus the reaction time can be increased or shortened, depending upon the amount of alkali added at any given time, for a given gas pressure and temperature of reaction.

The bleached and delignified pulp can be further processed in accordance with known methods, as desired. It can, for example, be bleached with chlorine and/or sodium chlorite and/or chlorine dioxide, and it may also be subjected to continuous refinements, in accordance with known procedures.

The pulp can be pretreated with acid at 10° to 80° C. to remove transition metal compounds under such conditions that acid hydrolysis of the carbohydrates is negligible.

When producing pulps for high strength papers, a pretreatment stage or part thereof is preferably carried out in the presence of a complexing agent for bivalent and/or polyvalent metal ions, such as copper, iron, manganese, cobalt and vanadium. Any of the above chelating or complex-forming compounds can be used. In this way, it is possible to remove and/or render harmless ions of the so-called transition metals, which catalyze an oxidative degradation of the carbohydrates during the subsequent delignification process. Examples of suitable complexing agents are chelating salts of nitrogen-containing polycarboxylic acids of the class set forth above in conjunction with the magnesium complex as well as polyphosphates and ethylenediamine and ethylenediamine derivatives, although other complexing agents of an inorganic or organic nature can also be used to advantage. The effect can be increased if mixtures of different complexing agents are used, since certain complexing agents have more of an affinity for certain polyvalent metal ions than others, and a blend is better capable of chelating a mixture of polyvalent metal ions for this reason.

It may be desirable to wash the pulp with water between the pretreatment stage and the oxygen delignification process. This washing step may be desirable in the case of any of the pretreatment processes described above. The washing, however, increases the cost of the processing, and also increases the risk of water contamination of the pulp with metal ions and metal compounds, and consequently it may often be more practical to omit the washing step, unless it can be carried out with deionized water, at low cost. Omission of the washing is usually disadvantageous.

The chemicals used for the delignification process can be recovered after the waste liquor is burned and subsequent to optionally causticizing all or part of the carbonate obtained when burning the liquor.

Preferred embodiments of the delignification and bleaching process of cellulose pulps of the invention are shown in the following Examples:

EXAMPLES 1 TO 4

A low consistency bleaching/delignification was carried out in a laboratory reactor at a pulp concentration of 1% in the presence of 0.05 M of sodium hydroxide at 106° C. and an oxygen gas pressure of 0.8 MPa (absolute), with a constant addition of magnesium sulfate, corresponding to 0.05 g magnesium per liter. The control run was in the presence of magnesium sulfate but without aromatic diamine. In the Examples with aromatic diamines, the amount added was 0.2 g/l.

The pulp used was an unbleached commercial kraft pulp from softwood, mainly pine, having the intrinsic viscosity 1180 $dm^3/kg$, and the Kappa number was 32. The bleaching time was varied and the intrinsic viscosity of the pulp was determined as a function of the Kappa number. Interpolated figures corresponding to the Kappa numbers 9 and 13 are shown in Table I.

TABLE I

| Example | Aromatic Diamine | Pulp Intrinsic viscosity ($dm^3/kg$) at Kappa number 9 | 13 |
|---|---|---|---|
| Control A | None | 890 | 960 |
| 1 | o-Phenyl diamine | 955 | 1025 |
| 2 | N,N—dimethyl-p-phenylene diamine | 950 | 1000 |
| 3 | N,N'—di-sec-butyl-p-phenylene diamine | 915 | 960 |
| 4 | Spent bleaching liquor from Example 1 containing residual o-phenylene diamine | 930 | 990 |

The Table shows that the highest selectivity was obtained with o-phenylene diamine. The improvement in lessening degradation as compared to the Control with addition of magnesium only was greater than the improvement in lessening degradation one normally expects with magnesium additions. Thus the pulp can be bleached to a Kappa number of less than 9 without lowering the viscosity below 950 $dm^3/kg$.

The process enables delignification to a Kappa number below 8 without decreasing the tensile strength of prepared paper in any appreciable degree.

A great improvement was also obtained with p-phenylene diamine, with two methyl groups substituted at one of the amino groups. An apparently smaller effect was obtained when introducing secondary butyl groups at both the amino groups.

Spent bleaching liquor from Example 1 was used in Example 4 without any further addition of amine, but with addition of sodium hydroxide, so that the bleaching went slightly faster than in the Control. Acceleration of bleaching diminishes selectivity. As the Table shows, an improved selectivity was obtained in Example 4, compared to the Control. Apparently, the spent liquor from the delignification with addition of aromatic diamines contains compounds which protect the carbohydrates of the pulp against degradation. This means that the amount of aromatic diamine added can be decreased in continuous operation, with recycled waste liquor.

EXAMPLES 5 TO 8

Another kraft softwood (mainly pine) pulp of the same type as Examples 1 to 4, having an intrinsic viscosity of 1170 $dm^3/kg$, and a slightly higher Kappa number, 34, was used. In these Examples, 0.2 g/l of one of the three isomeric unsubstituted o-, m- and p-phenylene diamines was added. The Control without and the Examples with the phenylene diamines were in all other respects made under the conditions of Examples 1 to 4.

TABLE II

| Example | Aromatic Diamine | Pulp Intrinsic viscosity ($dm^3/kg$) at Kappa number 9 | 13 |
|---|---|---|---|
| Control B | None | 870 | 930 |
| 5 | o-Phenylene diamine | 905 | 960 |
| 6 | p-Phenylene diamine | 905 | 960 |
| 7 | m-Phenylene diamine | 905 | 960 |
| 8 | Spent bleaching liquor | 920 | 970 |
| Control C | Diethylenetriamine pentamethylene phosphonic acid (DTPMP) | 890 | 950 |

As shown in Table II, a considerable effect in inhibiting degradation upon addition of aromatic diamine was also obtained with this pulp. However, when compared to the same Kappa number, this pulp gave a lower viscosity both in the Control and in the Examples with aromatic diamine than the pulp used previously. The reason for this is not known.

In Example 8, the bleaching liquor consisted of a spent bleaching liquor obtained from oxygen bleaching at 2% pulp consistency with an addition of 0.4 g/l of o-phenylene diamine. The liquor was replenished with sodium hydroxide, but no other additions were made. This Example gave a better selectivity than any of the others, and confirms that spent liquor from bleaching containing o-phenylene diamine gives effective protection against carbohydrate degradation. In continuous operation, with recycling of spent liquor from the oxygen delignification, one can decrease the addition of aromatic diamine, and in spite of this obtain an improved selectivity.

Control C shows that a certain protective effect was also obtained with DTPMP, but the effect was less than that obtained with the phenylene diamines.

EXAMPLES 9 TO 12

An aqueous solution of magnesium sulfate to which varying amounts of o-phenylene diamine had been added was mixed at room temperature in a kneading apparatus into unbleached kraft pulp from sofwood, mainly pine, having an intrinsic viscosity of 1130 $dm^3/kg$ and a Kappa number 32.1, prior to delignification. After five minutes, a sodium hydroxide solution was mixed in. The pulp concentration of the suspension was 4.5%.

o-Phenylene diamine was added in amounts varied up to 4 g/l, based on the total amount of water in the system. The addition of magnesium sulfate was kept constant and corresponded to 0.22 g/l of magnesium, calculated in the same way. The pulp was filtered and separated and pressed, so that the pulp content of the filter cake amounted to 30%. The amount of sodium hydroxide was 2% of the dry weight of the pulp.

The pulp cake was crumbled, and oxygen bleached at 0.8 MPa and 112° C. during varying time periods, so that pulps with different Kappa numbers were obtained. The intrinsic viscosity was determined as a function of the Kappa number, and interpolated values at Kappa number 11 have been put together in Table III.

TABLE III

| Example | Amount of o-phenylene diamine g/l | Pulp Intrinsic viscosity ($dm^3/kg$) at Kappa number 11 |
|---|---|---|
| Control D | None | 870 |
| 9 | 0.04 | 920 |
| 10 | 0.1 | 935 |
| 11 | 0.2 | 930 |
| 12 | 0.8 | 925 |
| Control E | 4.0 | 890 |

As is shown in Table III, o-phenylene diamine exerts a considerable protective action also in high-consistency bleaching in the presence of a large amount of magnesium compound. A large improvement in selectivity is obtained at an added amount corresponding to 0.04 g/l in the solution adhering to the cellulose pulp, calculated as above described. Under the conditions used, as optimum effect was obtained at an added amount of 0.1 g/l, while a decrease was obtained with larger amounts.

Control E shows that with the same pulp, with an added amount of 4 g/l of o-phenylene diamine, the viscosity at Kappa number 11 decreased to 890 $dm^3/kg$, a value only 20 units higher than Control D, without any other addition than magnesium sulfate.

At an addition of 4 g/l, 2.5 hours were required to reach Kappa number 11, whereas 45 minutes treatment with oxygen gas gave Kappa number 11 at 0.1 g/l. Large additions of o-phenylene diamine thus have obvious disadvantages, not to mention the cost for the additive.

Tests were also made with another pulp of the type described above, having a Kappa number of 29.0, in which magnesium addition was decreased to 0.044 g/l. A distinct improvement in selectivity was obtained at an addition as small as 0.01 g/l of o-phenylene diamine, whereas the effect was not significant when the addition amounted to 0.002 g/l, in tests carried out according to this process, which did not include any recycling of spent bleaching liquor. When spent bleaching liquor was recycled to the oxygen gas delignification, a positive effect was obtained, even with this low addition.

As the Examples show, the process of the invention makes it possible to decrease the lignin content (Kappa number) of the pulp considerably by the addition of a small amount of protectors which are not especially expensive. Since the amount added is so low, the cost is very reasonable, especially since one does not need any extra washers, presses or reaction vessels in the process of the invention, but can add the chemicals directly in the presently existing process. The spent liquor is combusted and the combustion can be integrated directly with the burning of the spent digestion liquor.

Since the amount of residual lignin in the pulp after the oxygen delignification is low, the need for chlorine based bleaching agents for final bleaching of the pulp is much smaller than in the presently used technique for oxygen delignification. The process therefore results in a decreased discharge of water-polluting substances, and in a decreased consumption of expensive and energy-consuming bleaching chemicals.

Swedish Pat. No. 73 15350-4 describes the use of triethanolamine as a protector in the alkaline oxygen bleaching of cellulose pulp. This protector is a well-known complex-former for catalytically active metal compounds. It is stated that triethanolamine together with magnesium salts gives an even better protective effect than magnesium salts alone. However, the inventor himself, Eero Sjostrom, has observed in *Paperi ja Puu* (Paper and Wood) No. 1, 1978, second column on page 40, "Inhibition of carbohydrate degradation during oxygen bleaching":

> "It has been shown in a number of experiments that TEA together with magnesium usually (9.33) but not always gives an additional stabilizing effect. The reason for these somewhat contradictory results is not clearly understood and no systematic studies were made here. It appears, however, that the combined effect can be more or less pronounced depending on the impurities present in the pulp and on how effectively the inhibitor is distributed in the pulp".

Swedish Pat. No. 335,053 describes the leaching out of deleterious metal compounds with acid and/or complex-forming agents before the oxygen bleaching of pulp. Among the complex-forming agents cited is ethylenediamine, which is known to give strong complexes with metals. Example 4 describes the preparation of sulfite pulp of low viscosity. It is quite clear that oxygen bleaching in the presence of ethylenediamine gives a strong degradation of the cellulose. This is the opposite effect to the effect of aromatic diamines.

As is evident from Example 4, the unbleached spruce sulfite pulp had a Kappa number of 12.6, and a viscosity of 1144 $cm^3/g$, whereas the pulp after oxygen bleaching had a Kappa number of 4.3 and a viscosity of 675 $cm^3/g$. In this test, the unbleached pulp was washed with an aqueous solution containing ethylenediamine in an amount of 0.2% based on the dry weight of the pulp. Liquid was pressed out to a solids content of 50%, after which sodium hydroxide was added. This means that a certain amount of ethylenediamine accompanied the pulp into the oxygen gas bleaching stage. Evidently ethylenediamine does not work as a protector for the carbohydrates during oxygen delignification.

Examples 1 to 4 were repeated with the additions of one of benzylamine, nitrobenzene and dimethylaminobenzoic aldehyde together with magnesium, added to the pulp before the oxygen treatment. Benzylamine and nitrobenzene gave the same result as the Control of Table I. Dimethylaminobenzoic aldehyde gave the same viscosity as the Control at Kappa number 13, whereas at Kappa number 9 an increase of 15 $dm^3/kg$ was obtained, which hardly is a significant effect.

Triethanolamine and ethylenediamine are complex-forming agents for catalytically active metal compounds. Aromatic diamines, and especially those with both the amino groups linked to an aromatic ring, differ in function during the oxygen delignification. We have not been able to explain the function of the aromatic amines during oxygen delignification, but as is evident from the test results, the protective effect does not depend on the formation of complexes with deleterious metal compounds.

A characteristic feature of aromatic diamines is that they show a distinct additive effect to the effect of magnesium in oxygen bleaching, in the protection of carbohydrates against degradation. A remarkable and surprising fact is that the added amount of aromatic diamines is critical and that the protective effect decreases at high additions. Aromatic diamines are functionally comparable with formaldehyde, which, however, gives rise to the evolution of hydrogen gas during oxygen delignification, which is an explosion hazard.

Having regard to the foregoing disclosure, the following is claimed as the inventive and patentable embodiments thereof:

1. A process for the alkaline oxygen delignification and bleaching of chemical cellulose pulp while inhibiting degradation of carbohydrates in the cellulose pulp, which comprises alkaline oxygen delignifying and bleaching chemical cellulose pulp in the presence of an aromatic diamine having at least one amino group directly attached to an aromatic ring and having the formula:

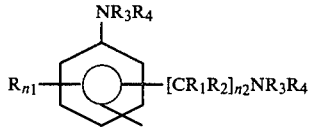

in which:

R is selected from the group consisting of hydrogen, alkyl, aryl and alkylaryl (the aryl including aryl condensed with the

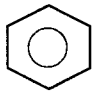

ring), cycloalkyl and alkyl cycloalkyl (the cycloalkyl including cycloalkyl condensed with the

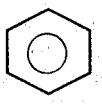

ring), the alkyl having from one to six carbon atoms, the aryl having from six to eighteen carbon atoms, the cycloalkyl having from five to seven carbon atoms; hydroxyl and carboxylic acid;

$R_1$, $R_2$, $R_3$ and $R_4$ are selected from the group consisting of hydrogen, alkyl having from one to six carbon atoms, aryl having from six to ten carbon atoms, and cycloalkyl having from five to eight carbon atoms;

$n_1$ is a number from one to four; and $n_2$ is a number from zero to six, the aromatic diamine being in an amount sufficient to inhibit degradation of carbohydrates in the cellulose pulp during said delignifying and bleaching, said alkaline oxygen delignifying and bleaching being with oxygen and alkaline chemical in an aqueous liquid phase under superatmospheric pressure at an elevated temperature of at least 80° C.

2. A process according to claim 1 in which the aromatic diamine has two amino groups directly attached to an aromatic ring.

3. A process according to claim 2 in which the amino groups are both attached to the same aromatic ring.

4. A process according to claim 3 in which the aromatic diamine is phenylene diamine.

5. A process according to claim 1 in which a magnesium compound is also present during delignifying and bleaching.

6. A process according to claim 2 in which the amino groups are in the same aromatic ring, in o-position on the ring.

7. A process according to claim 2 in which the amino groups are in the same aromatic ring, in m-position on the ring.

8. A process according to claim 2 in which the amino groups are in the same aromatic ring, in p-position on the ring.

9. A process according to claim 1 in which the aromatic diamine is selected from the group consisting of the isomeric diaminophenyl acetic acids, diaminobenzoic acids, diaminobenzyl alcohols, diaminophenols, diaminonaphthols, and phenylenediamines.

10. A process according to claim 1 in which the aromatic diamine is added to said alkaline and bleaching chemical before delignification.

11. A process according to claim 1 in which the aromatic diamine is added to said alkaline and bleaching chemical during delignification.

12. A process according to claim 1 in which the amount of aromatic diamine added is within the range from about 0.002 g/l to about 0.8 g/l in the alkaline delignification reaction medium.

13. A process according to claim 1 in which the amount of aromatic diamine added is within the range from about 0.01 g/l to about 0.2 g/l in the alkaline delignification reaction medium.

14. A process according to claim 1 in which spent bleaching liquor is recovered at the end of the delignification and bleaching and recycled.

15. A process according to claim 1 in which a magnesium compound is added to the alkaline delignification and bleaching chemical in an amount within the range from about 0.02 to about 0.5%, calculated as magnesium, and based on the dry weight of the pulp.

16. A process according to claim 1 in which the alkaline chemical is sodium hydroxide.

17. A process according to claim 16 in which the sodium hydroxide is added as oxidized white liquor.

18. A process according to claim 1 in which the chemical cellulose pulp is selected from the group consisting of soda pulp, sulfate pulp, kraft pulp, polysulfide pulp, sulfite pulp, and semichemical pulp.

19. A process according to claim 1 in which a magnesium compound selected from the group consisting of magnesium salts, magnesium oxide and magnesium hydroxide is also present during said delignification and bleaching.

20. A process according to claim 19 in which the magnesium compound is combined with a complexing agent selected from the group consisting of aminopolycarboxylic acids having the formula:

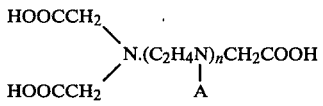

in which A is the group $—CH_2COOH$ or $—CH_2CH_2OH$, where n is an integer from zero to five; aliphatic alpha-hydroxycarboxylic acids of the type RCHOHCOOH and the corresponding beta-hydroxycarboxylic acids $RCHOHCH_2COOH$, where R is hydrogen or an aliphatic radical having from one to about ten carbon atoms and from zero to nine hydroxyl groups; polycarboxylic acids having at least two carboxylic acid groups, and from zero to ten hydroxyl groups; polyphosphoric acids; and aminomethylene phosphonic acids.

21. A process according to claim 20 in which upon conclusion of the alkaline oxygen delignification and bleaching, the magnesium-containing waste liquor is separated, additional magnesium compound added, if necessary, to restore the magnesium content, and maintain a high enough level to inhibit oxidative degradation of the cellulose or hemicellulose, and the liquor then recycled.

22. A process according to claim 1 in which the partial pressure of oxygen during the bleaching is within the range from about 2 to about 12 atmospheres.

23. A process according to claim 1 in which the oxygen gas is supplied as air during the process, and air enriched with inert gas during the process is released and vented.

24. A process according to claim 1 in which the bleaching is carried out at a temperature within the range from about 80° to about 150° C.

25. A process according to claim 1 in which the consistency of cellulosic material in the reaction mixture is within the range from about 1 to about 40%.

26. A process according to claim 1 in which the alkaline chemical is NaOH and is within the range from about 1 to about 10% NaOH, based on the weight of the cellulosic material present.

27. A process according to claim 1 in which the reaction time is within the range from about 60 to about 500 minutes.

28. A process according to claim 1 in which the bleached and delignified pulp is further bleached with at least one member selected from the group consisting of chlorine, sodium chlorite and chlorine dioxide.

29. A process according to claim 1 in which the chemical cellulose pulp is pretreated before the bleaching and delignification with at least one member selected from the group consisting of water and aqueous acidic, neutral, and alkaline solutions.

30. A process according to claim 29 in which the cellulose pulp is treated with a complexing agent for complexing transition metal compounds which are removed before the oxygen delignification.

31. A process according to claim 30 in which the complexing agent is diethylenetriaminepentaacetic acid.

* * * * *